US010830128B2

(12) United States Patent
Clark

(10) Patent No.: US 10,830,128 B2
(45) **Date of Patent: *Nov. 10, 2020**

(54) TWO-STROKE ENGINE HAVING FUEL/AIR TRANSFER PISTON

(71) Applicant: Roland Clark, Huntington Beach, CA (US)

(72) Inventor: Roland Clark, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/378,509

(22) Filed: Apr. 8, 2019

(65) Prior Publication Data

US 2019/0376446 A1 Dec. 12, 2019

Related U.S. Application Data

(63) Continuation-in-part of application No. 15/433,955, filed on Feb. 15, 2017, now Pat. No. 10,253,680.

(51) Int. Cl.

| | |
|---|---|
| ***F02B 75/12*** | (2006.01) |
| ***F02B 33/22*** | (2006.01) |
| ***F02B 1/04*** | (2006.01) |
| ***F02B 75/02*** | (2006.01) |

(52) U.S. Cl.

CPC ..... *F02B 75/12* (2013.01); *F02B 1/04* (2013.01); *F02B 33/22* (2013.01); *F02B 75/02* (2013.01); *F02B 2075/025* (2013.01)

(58) Field of Classification Search

CPC .. F02B 75/12; F02B 1/04; F02B 33/22; F02B 75/02; F02B 2075/025

See application file for complete search history.

(56) References Cited

U.S. PATENT DOCUMENTS

| | | | | | |
|---|---|---|---|---|---|
| 1,881,582 | A * | 10/1932 | Holloway | F02B 25/00 | 123/59.7 |
| 2,110,248 | A * | 3/1938 | Wagner | F02B 41/06 | 123/52.3 |
| 2,271,011 | A * | 1/1942 | Hubbard | F02B 25/00 | 123/54.1 |
| 2,844,131 | A * | 7/1958 | Beveridge | F02B 25/145 | 123/73 A |
| 2,905,159 | A * | 9/1959 | Larson | F02B 19/02 | 123/258 |
| 4,351,290 | A * | 9/1982 | Melchior | F02B 27/04 | 123/559.2 |
| 4,458,635 | A * | 7/1984 | Beasley | F02B 33/22 | 123/39 |
| 5,072,589 | A * | 12/1991 | Schmitz | F02B 41/08 | 123/560 |
| 5,353,753 | A * | 10/1994 | McGrath | F01M 1/16 | 123/196 R |
| 5,771,849 | A * | 6/1998 | Hamy | F01L 3/205 | 123/73 R |

(Continued)

*Primary Examiner* — Hung Q Nguyen
(74) *Attorney, Agent, or Firm* — Roy A. Ekstrand

(57) ABSTRACT

A two-stroke engine includes an engine block which defines a fuel/air transfer cylinder and a combustion cylinder. A piston is operative within the combustion cylinder in a two-stroke power producing manner while a fuel/air transfer piston is operative within the fuel/air transfer cylinder to inject fuel/air mixture into the combustion cylinder. The engine further includes a cylinder head which supports a plurality of movable valves to control the flow of air and fuel through the engine.

4 Claims, 6 Drawing Sheets

(56) References Cited

U.S. PATENT DOCUMENTS

| | | | | |
|---|---|---|---|---|
| 5,857,436 | A * | 1/1999 | Chen | F02B 33/22 123/68 |
| 7,219,630 | B2 * | 5/2007 | Patton | F01L 1/022 123/25 C |
| 8,051,811 | B2 * | 11/2011 | Phillips | F01L 1/465 123/261 |

* cited by examiner

TWO-STROKE ENGINE HAVING FUEL/AIR TRANSFER PISTON

CROSS-REFERENCE TO RELATED APPLICATION

This application is a Continuation-In-Part of co-pending U.S. patent application Ser. No. 15/433,955 entitled INTERNAL COMBUSTION ENGINE HAVING BELLOWS FUEL/AIR INDUCTION SYSTEM, filed Feb. 15, 2017 in the name of Roland Clark, the disclosure of which is hereby incorporated herein by reference.

FIELD OF THE INVENTION

This invention relates generally to two-stroke internal combustion engines and particularly to the apparatus utilized in supplying the fuel/air mixture to the cylinder combustion chambers of the engine.

BACKGROUND OF THE INVENTION

The basic internal combustion engine has proven to be a reliable, flexible and highly effective source of power in a great number of applications and industries. Internal combustion engines have been applied to very small portable applications such as handheld equipment as well as to large commercial or industrial environments such as manufacturing facilities, power and utility companies and to a virtually endless variety of vehicles. In what is, perhaps, the most pervasive use of internal combustion engines, a variety of vehicles are powered by such engines and are used for both commercial and personal transport. While the design and fabrication of internal combustion engines has varied substantially over time to meet different application requirements, the basic internal combustion engine is relatively simple and direct.

Internal combustion engines generally include one or more cylinders within which a piston is moved in a reciprocating motion profile under the direct drive of a connecting rod and crankshaft. The crankshaft is rotationally supported by the engine block and provides eccentric couplings for the piston connecting rods. A fuel system controls the introduction of a fuel/air mixture into the combustion chambers of the cylinders and a source of ignition, such as a spark plug or the like, ignites the compressed fuel/air mixture and the fuel burns driving the piston through its power stroke. The power stroke of the piston causes rotation of the crankshaft and rotational power, or torque is produced.

Generally speaking, internal combustion engines may be divided into two cycle and four cycle engine types. Two cycle engines, also referred to as "two-stroke engines", acquire their name based upon the operational characteristic by which the reciprocating piston is moved through two strokes, or movements, during each engine cycle. The first stroke occurs following fuel ignition in which the piston moves downwardly in a power stroke. The second stroke occurs as the piston moves upwardly in a compression stroke. Thus, a charge of compressed fuel/air mixture is inducted, ignited, burned and thereafter exhausted from the engine during each rotation of the crankshaft.

Conversely, four cycle engines, also referred to as "four-stroke engines", acquire their name based upon piston movement through four piston strokes during each operational cycle. Accordingly, each piston in a four stroke internal combustion engine moves downwardly through an intake stroke, drawing fuel/air into the cylinder and upwardly through a compression stroke in which the fuel/air mixture is compressed. Once the fuel/air mixture is compressed, ignition takes place and the piston moves downwardly through a power stroke. Finally, the piston moves upwardly through an exhaust stroke in which burned gases are exhausted from the cylinder. In a four stroke engine the crankshaft is rotated twice for each engine cycle.

For both two-stroke and four stroke internal combustion engines, practitioners in the art have endeavored to increase the power output and fuel efficiency of the engines. Efforts to provide such improvements have typically involved systems for increasing the amount of fuel/air mixture is injected or drawn into the combustion chambers of the engines. These efforts have included reason according to external apparatus such as blowers, superchargers and turbochargers which essentially comprise air pumps or compressors that force air or fuel/air mixture into the combustion chambers of the engines under great pressure. Blowers typically provide air pumps, or compressors, driving pressurized air into the engine carburetors. The power to operate the blowers is provided by a system of engine-driven belts, pulleys and/or gears driven by the engine crankshaft.

Superchargers, on the other hand, typically involve compressors or air pumps which compress a fuel/air mixture that is driven into the engine intake manifold. In similarity to blowers, superchargers also derive power from a system of engine-driven belts, pulleys and/or gears driven by the engine crankshaft.

Turbochargers provide air pumps or compressors deriving their power from a turbine energized by the flow of exhaust gases from the engine. Thus, turbochargers are in essence exhaust-driven blowers.

Unfortunately, blowers, superchargers and turbochargers have proven to be prohibitively expensive and complex in their structure and operation. When used in vehicles, they often require extensive additional within the engine compartment of the vehicle. Additional problems arise in the operation of such vehicles which may complicate throttle and control systems of the host vehicle. Throttle response is often compromised by such devices. One of the more vexing problems encountered in such devices is known generally in the art as "throttle lag" characterized by a "pause or dead spot" in engine response to throttle action. Such devices also may be found to reduce the fuel efficiency of the engine.

In the face of the continuing need to provide evermore improved internal combustion engine performance practitioners in the art have applied a variety of technologies. For example, U.S. Pat. No. 5,220,899 issued to Ikebe et al, sets forth an INTERNAL COMBUSTION ENGINE WITH AIR ASSIST FUEL INJECTION CONTROL SYSTEM in which an internal combustion engine of the type having a fuel injection valve is provided with an assist air supply device for finely atomizing fuel includes a swirl control device for producing a swirl in the combustion chamber of the engine.

U.S. Pat. No. 7,252,076 issued to Cho sets forth an INTERNAL COMBUSTION ENGINE WITH AIR-FUEL MIXTURE INJECTION includes a structure for supplying assist air to an air-fuel mixture injection valve including a device for limiting the intake air taken by a compressor whereby a drive force of the compressor required for compressing air is reduced and fuel efficiency is achieved.

U.S. Pat. No. 6,481,393 and published US patent application 2005/0076881 in the name of Drew set forth an INTERNAL COMBUSTION ENGINE with COMPOUND PISTON ASSEMBLY while U.S. Pat. No. 3,786,790 issued to Plevyak sets forth a DOUBLE CHAMBERED RECIPROCATEABLE DOUBLE ACTION PISTON INTERNAL COMBUSTION ENGINE.

Additionally, U.S. Pat. Nos. 4,216,753 and 4,414,944 set forth early attempts to improve the efficiency and performance of internal combustion engines. Finally, published US patent applications US 2016/0017845, US 2014/0144406 and US 2014/0076291 set forth more recent efforts to improve the efficiency and performance of internal combustion engines.

Practitioners in the engine arts pursuing evermore improved internal combustion engines tend to favor either four-stroke engine designs or two-stroke engine designs. Each type of engine enjoys a mixture of advantages and disadvantages. For example, two-stroke engines tend to produce greater power for a given engine size and weight. In addition, two-stroke engines require fewer external components than four-stroke engines. Thus, for any given power output requirement, two-stroke engines are advantageous over four-stroke engines in that they are smaller, lighter and less complex than four-stroke engines producing the given power output.

Unfortunately, two-stroke engines are also subject to several significant disadvantages when compared to four-stroke engines. For example, the fuel/air systems of present day two-stroke engines utilize a combination of a pressurized crankcase and fuel transfer ports to supply fuel/air mixture to the combustion cylinder through cylinder wall ports. This fuel system necessitates the pre-mixture of fuel and lubricating oil supplied to the engine. The combustion of the fuel/oil mixture results in prohibitively "dirty" engine emissions. With the current trend of environmental regulations throughout most of the industrialized nations, this dirty operating characteristic subjects two-stroke engines to great disadvantage and often limits their use. As a result, the use of two-stroke engines frequently proves undesirable in many applications despite their substantial advantages of smaller size, lighter weight and greater power compared to the more pervasive four-stroke engines.

There Remains Therefore a Long Felt Unresolved and Continuing Need in the Art for More Improved, Two-Stroke Internal Combustion Engines which are Capable of Overcoming the Need for Mixing the Fuel and Lubricating Oil Supplied to the Engine

SUMMARY OF THE INVENTION

Accordingly, it is a general object of the present invention provide an improved two-stroke engine. It is a more particular object of the present invention to provide an improved two-stroke engine which overcomes the need to premix fuel and lubricating oil prior to combustion. It is a still more particular object of the present invention to provide an improved two-stroke engine that avoids the need for creating a pressurized condition within the engine crankcase. It is a still more particular object of the present invention to provide an improved two-stroke engine that may be operated utilizing either a dry sump or wet sump lubricating system.

In accordance with the present invention, there is provided a two-stroke engine comprising: an engine block defining a combustion cylinder bore and a transfer cylinder bore; a cylinder head supported upon the engine block overlying the combustion cylinder bore and the transfer cylinder bore defining a first cylinder head volume aligned with the combustion cylinder bore and a second cylinder head volume aligned with the transfer cylinder bore, an intake port extending from the second cylinder head volume, an exhaust port extending from the first cylinder head volume, and a transfer port extending between the first cylinder head volume and the second cylinder head volume; a first intake valve supported within the cylinder head providing closure of the transfer port; an exhaust valve supported within the cylinder head providing closure of the exhaust port; a fuel igniter supported within the cylinder head and extending into the first cylinder head volume; a second intake valve supported within the cylinder head providing closure of the intake port; a crankshaft rotatably supported upon the engine block having first and second eccentric crankshaft lobes; a combustion cylinder piston movable within the combustion cylinder bore and a first connecting rod coupling the combustion cylinder piston to the first eccentric crankshaft lobe; a transfer cylinder piston movable within the transfer cylinder bore and a second connecting rod coupling the transfer cylinder piston to the second eccentric crankshaft lobe; and a camshaft rotatably coupled to the crankshaft operative to open and close the first and second intake valves and the exhaust valve.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
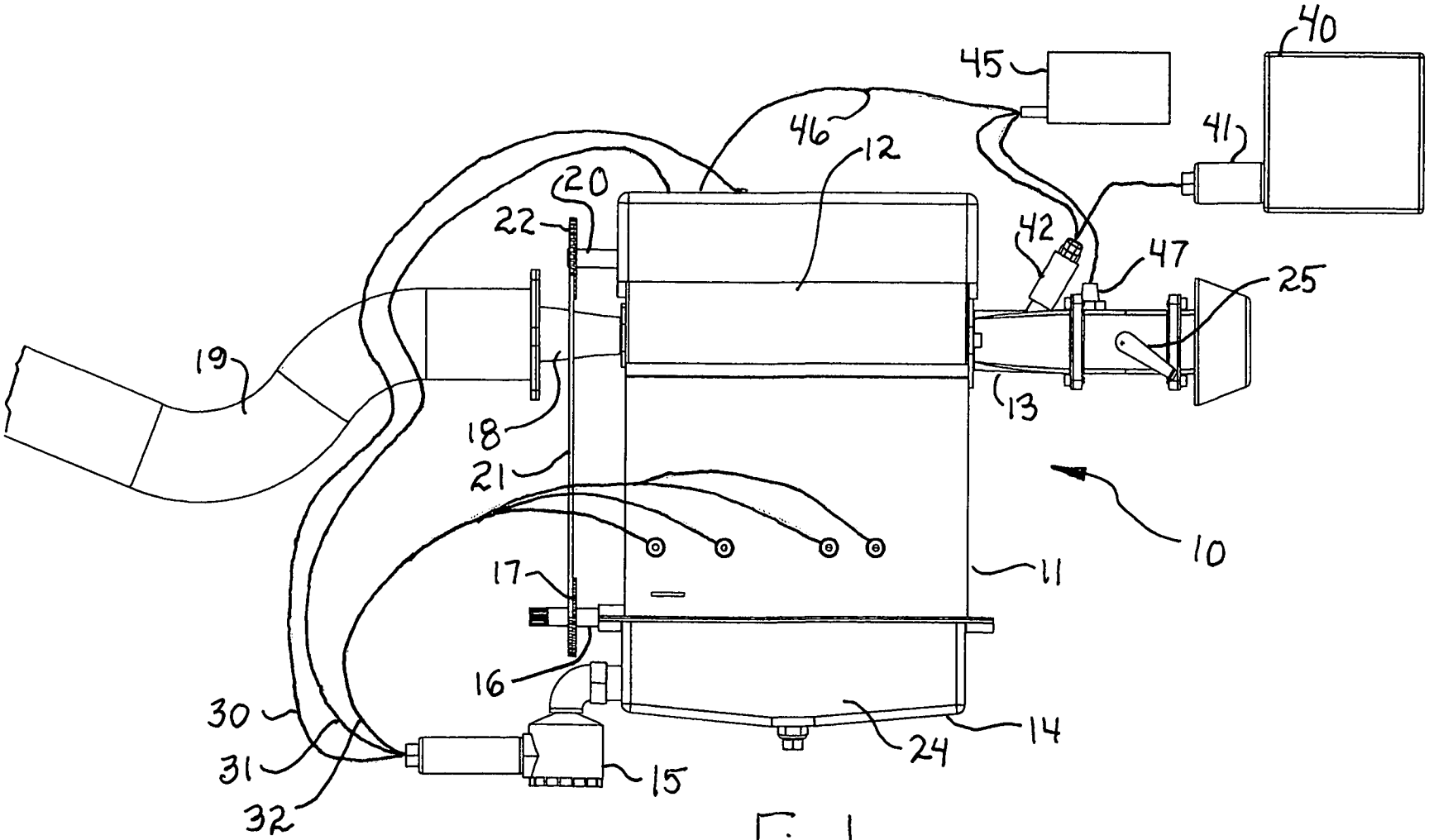
FIG. 1 sets forth a side elevation view of a two-stroke engine having fuel/air transfer piston constructed in accordance with the present invention utilizing a wet sump lubrication system.

FIG. 1 sets forth a side elevation view of a two-stroke engine having fuel/air transfer piston constructed in accordance with the present invention utilizing a wet sump lubrication system generally referenced by numeral 10. Engine 10 includes an engine block 11 which, as is better seen below, defines an air/fuel transfer cylinder and a combustion cylinder. Engine 10 further includes a cylinder head 12 which, as is also set below in greater detail, supports a plurality of movable valves to control the flow of air and fuel through engine 10. Engine 10 further includes and intake 13 which is coupled to cylinder head 12 and which, in turn, supports a throttle control 25. Intake 13 further supports a flow sensor 47 and a fuel injector 42. Engine 10 also includes a fuel pump 40 which may comprise a conventional electric fuel pump and which will be understood to be coupled to a conveniently located fuel tank (not shown). Fuel pump 40 provides a pressurized flow of fuel which is coupled by a fuel line 41 to fuel injector 42.

Engine 10 further includes an engine controller 45 which is preferably microprocessor based and which provides electronic control of fuel injector 42 and receives input information from sensor 47. Engine control 45 also includes a source of electronic ignition which is coupled to engine 10 by an ignition line 46.

Engine block 11 further supports a crankcase 14 within which a crankcase 24 volume is formed. An oil pump 15 is coupled to the interior of crankcase 24 and is operative to provide a pressurized flow of lubricating oil which is coupled to the appropriate portions of engine 10 by a plurality of oil pressure lines 30, 31 and 32. A crankshaft 16 is rotatably supported by engine block 11 and further supports a timing gear 17. Cylinder head 12 rotatably supports a camshaft 20 which, in turn, supports a cam gear 22. A timing chain 21 engages timing gear 17 and cam gear 22 to synchronize the rotation of camshaft 20 to crankshaft 16. Cylinder head 12 further supports an exhaust output 18 which, in turn, is joined to an exhaust pipe 19.

Figure 2:
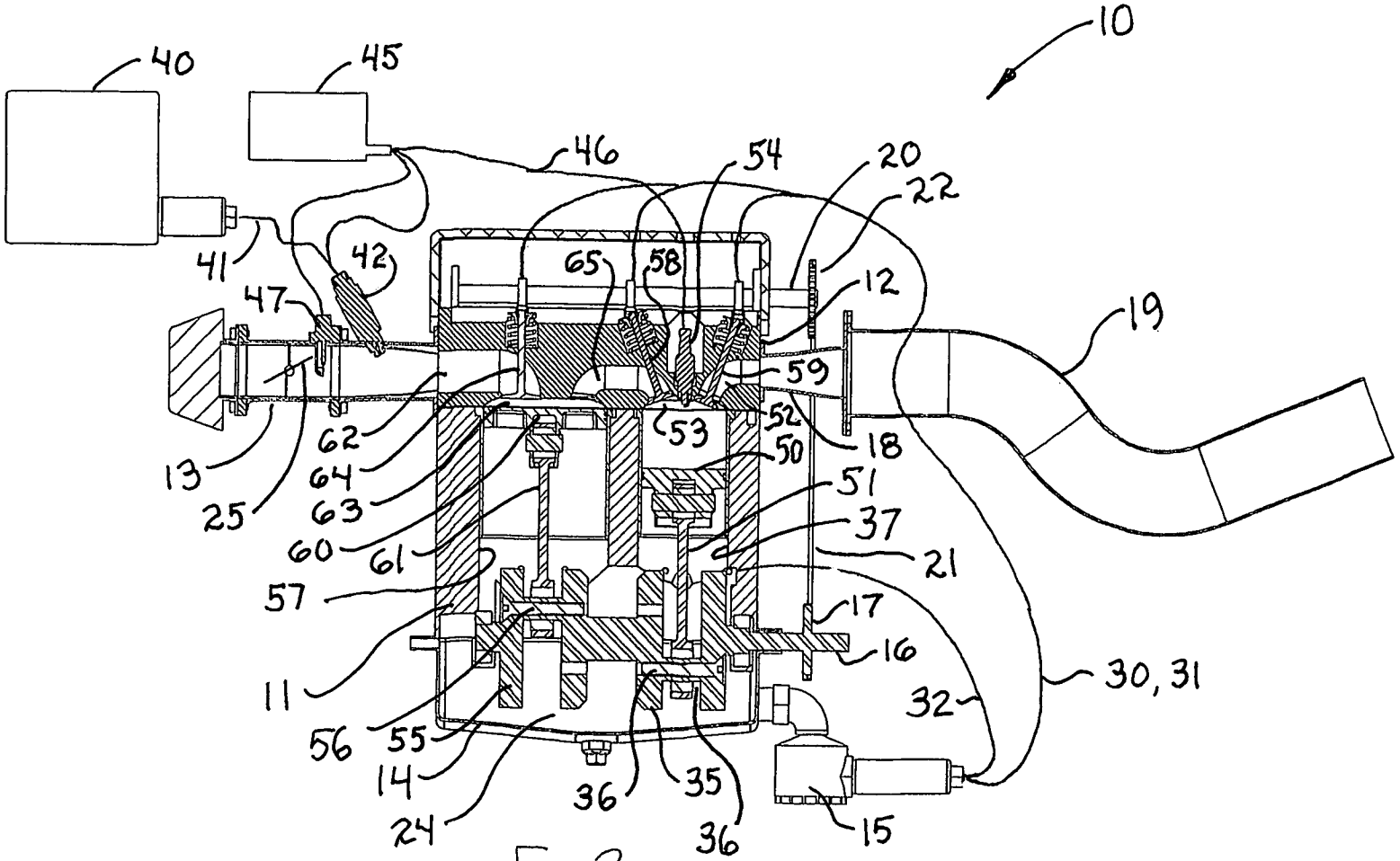
FIG. 2 sets forth a section view of the two-stroke engine having fuel/air transfer piston of FIG. 1 constructed in accordance with the present invention.

FIG. 2 sets forth a section view of engine 10. As is described above, engine 10 includes an engine block 11 which, as is better seen below, defines an air/fuel transfer cylinder and a combustion cylinder. Engine 10 further includes a cylinder head 12 which, as is also set below in greater detail, supports a plurality of movable valves to control the flow of air and fuel through engine 10. Engine 10 further includes and intake 13 which is coupled to cylinder head 12 and which, in turn, supports a throttle control 25. Intake 13 further supports a flow sensor 47 and a fuel injector 42. Engine 10 also includes a fuel pump 40 which may comprise a conventional electric fuel pump and which will be understood to be coupled to a conveniently located fuel tank (not shown). Fuel pump 40 provides a pressurized flow of fuel which is coupled by a fuel line 41 to fuel injector 42.

As is also described above, engine 10 further includes an engine controller 45 which is preferably microprocessor based and which provides electronic control of fuel injector 42 and receives input information from sensor 47. Engine control 45 also includes a source of electronic ignition which is coupled to engine 10 by an ignition line 46.

As is also described above, engine block 11 further supports a crankcase 14 within which a crankcase 24 volume is formed. As previously mentioned, engine 10 is operated utilizing a wet sump lubrication system. Wet sump lubrication systems are characterized in that a quantity of oil is collected within the crankcase volume and a portion of the lubrication of the crankshaft and connecting rods are lubricated as they splash into the accumulated oil during crankshaft rotation. An oil pump 15 is coupled to the interior of crankcase 24 and is operative to provide a pressurized flow of lubricating oil which is coupled to the appropriate portions of engine 10 by a plurality of oil pressure lines 30, 31 and 32. A crankshaft 16 is rotatably supported by engine block 11 and further supports a timing gear 17. Cylinder head 12 rotatably supports a camshaft 20 which, in turn, supports a cam gear 22. A timing chain 21 engages timing gear 17 and cam gear 22 to synchronize the rotation of camshaft 20 to crankshaft 16. Cylinder head 12 further supports an exhaust output 18 which, in turn, is joined to an exhaust pipe 19.

Crankshaft 16 is rotatably supported at the bottom end of engine block 11 by a plurality of conventional bearings. Crankshaft 16 may be constructed in accordance with conventional fabrication techniques and includes offset eccentric crankshaft lobes 35 and 55. Crankshaft journal 36 is positioned off center or eccentric within crankshaft lobe 35. Similarly, crankshaft journal 56 is positioned within crankshaft lobe 55 in an offset or eccentric position. Of importance to note with respect to the present invention and as is set forth below in greater detail, the offsets of crankshaft journals 36 and 56 are substantially 180 crankshaft degrees apart. This phase relationship is described below in greater detail. However, suffice it to note here that the phase relationship between crankshaft journals 36 and 56 results in oppositely positioning their respective pistons within their respective cylinder bores.

Engine block 11 defines a combustion cylinder bore 37 and a transfer cylinder bore 57. A piston 50 is supported within combustion cylinder bore 37 for reciprocating movement and is joined to journal 36 of crankshaft lobe 35 by a connecting rod 51. Similarly, a fuel/air transfer piston 60 is positioned within transfer cylinder bore 57 for reciprocating movement and is coupled to journal 56 of crankshaft lobe 55 by a connecting rod 61. Thus, as crankshaft 16 is rotated, piston 50 is reciprocated within combustion cylinder bore 37 and fuel air transfer piston 60 is reciprocated within transfer bore 57.

Cylinder head 12 defines an intake port 62 and a cylinder head volume 63. An intake valve 64 is operative to open and close the flow passage between intake port 62 and cylinder head volume 63 under the control of camshaft 20. Cylinder head 12 further defines a cylinder head volume 53 having an exhaust port 52 in communication therewith. Cylinder head 12 also defines a fuel air transfer port 65 extending between cylinder head volumes 63 of transfer bore 57 to cylinder head volume 53 of combustion bore 37. An intake valve 58 is positioned within cylinder head 12 and is actuated by cam shaft 20. Intake valve 58 controls the flow between transfer port 65 and cylinder head volume 53. An exhaust valve 59 is supported within cylinder head 12 and is actuated by camshaft 20. Exhaust valve 59 operates to control the flow from cylinder head volume 53 through exhaust port 52. A spark plug 54 is supported within cylinder head 12 and extends into cylinder head volume 53.

In operation, as crankshaft 16 rotates, piston 50 is reciprocated within combustion cylinder bore 37 in a two-stroke operation in which camshaft 20 moves intake valve 58 to allow the introduction of a fresh charge of fuel air mixture into cylinder head volume 53 which is then compressed as valve 58 is closed and piston 50 moves upwardly until spark plug 54 is activated to ignite the fuel air mixture compressed within cylinder head volume 53. Thereafter, the burning fuel air mixture forces piston 50 back downwardly as camshaft 20 actuates exhaust valve 59 to expel burned gases from cylinder head volume 53.

In accordance with an important aspect of the present invention the out of phase relationship of substantially 180 crankshaft degrees between the reciprocation of piston 50 and piston 60 results in the downward movement of piston 60 as piston 50 moves upwardly and an upward movement of piston 60 as piston 50 moves downwardly. It will be noted that this phase relationship is expressed as "substantially 180 crankshaft degrees." However, it will be recognized that variations in this angular relationship of plus or minus small angular increments of approximately twenty crankshaft degrees may be utilized to achieve the desired tuning of the engine. Thus, the term "substantially 180 crankshaft degrees" will be understood to embrace variations of plus and/or minus twenty crankshaft degrees. As a result, each time piston 50 is reciprocated in accordance with the two-stroke power producing operation thereof, piston 60 moves downwardly while valve 64 is open drawing a fresh quantity of fuel/air mixture into transfer cylinder bore 57 which is then transferred as piston 60 moves upwardly and valve 64 closes through transfer port 65 past open valve 58 into cylinder head volume 53 providing a fresh charge of fuel/air mixture into combustion cylinder bore 37 as piston 50 begins its upward compression stroke. This operation continues as piston 60 in cooperation with valve 64 and camshaft 20 draws in successive fuel/air charges which are then transferred through transfer port 65 into combustion cylinder bore 37 each time the intake valve 58 is open to maintain the two-stroke power producing operation of engine 10.

It will be noted that the present invention stroke engine does not require the pressurizing of the engine crankcase and the transfer of fuel air mixture into the crankcase for flow upwardly through transfer ports as is required by conventional stroke engines. Accordingly, it will be noted that the present invention stroke engine may be operated in either a wet some or dry sump lubrication system without departing from the spirit and scope of the present invention.

Figure 3:
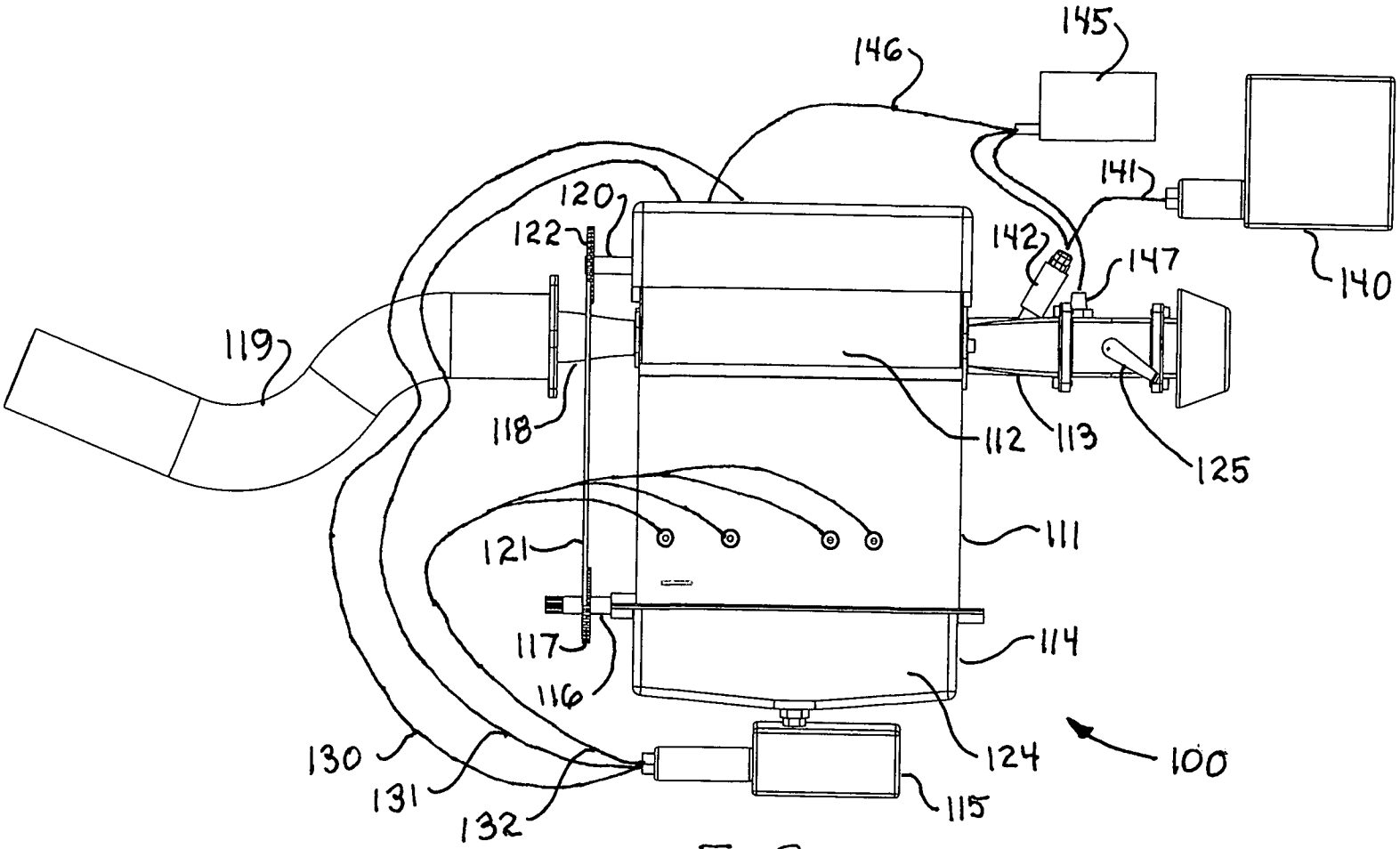
FIG. 3 sets forth a side elevation view of an alternate embodiment a two-stroke engine having fuel/air transfer piston constructed in accordance with the present invention utilizing a dry sump lubrication system.

FIG. 3 sets forth a side elevation view of an alternate embodiment a two-stroke engine having fuel/air transfer piston constructed in accordance with the present invention utilizing a dry sump lubrication system and generally referenced by numeral 100. Engine 100 includes an engine block 111 which, as is better seen below, defines an air/fuel transfer cylinder and a combustion cylinder. Engine 100 further includes a cylinder head 112 which, as is also set below in greater detail, supports a plurality of movable valves to control the flow of air and fuel through engine 100. Engine 100 further includes and intake 113 which is coupled to cylinder head 112 and which, in turn, supports a throttle control 125. Intake 113 further supports a flow sensor 147 and a fuel injector 142. Engine 100 also includes a fuel pump 140 which may comprise a conventional electric fuel pump and which will be understood to be coupled to a conveniently located fuel tank (not shown). Fuel pump 140 provides a pressurized flow of fuel which is coupled by a fuel line 141 to fuel injector 142.

Engine 100 further includes an engine controller 145 which is preferably microprocessor based and which provides electronic control of fuel injector 142 and receives input information from sensor 147. Engine control 145 also includes a source of electronic ignition which is coupled to engine 100 by an ignition line 146.

Engine block 111 further supports a crankcase 114 within which a crankcase 124 volume is formed. An oil pump 115 is coupled to the interior of crankcase 124 and is operative to provide a pressurized flow of lubricating oil which is coupled to the appropriate portions of engine 100 by a plurality of oil pressure lines 130, 131 and 132. A crankshaft 16 is rotatably supported by engine block 111 and further supports a timing gear 117. Cylinder head 112 rotatably supports a camshaft 120 which, in turn, supports a cam gear 122. A timing chain 121 engages timing gear 117 and cam gear 122 to synchronize the rotation of camshaft 120 to crankshaft 116. Cylinder head 112 further supports an exhaust output 118 which, in turn, is joined to an exhaust pipe 119.

Figure 4:
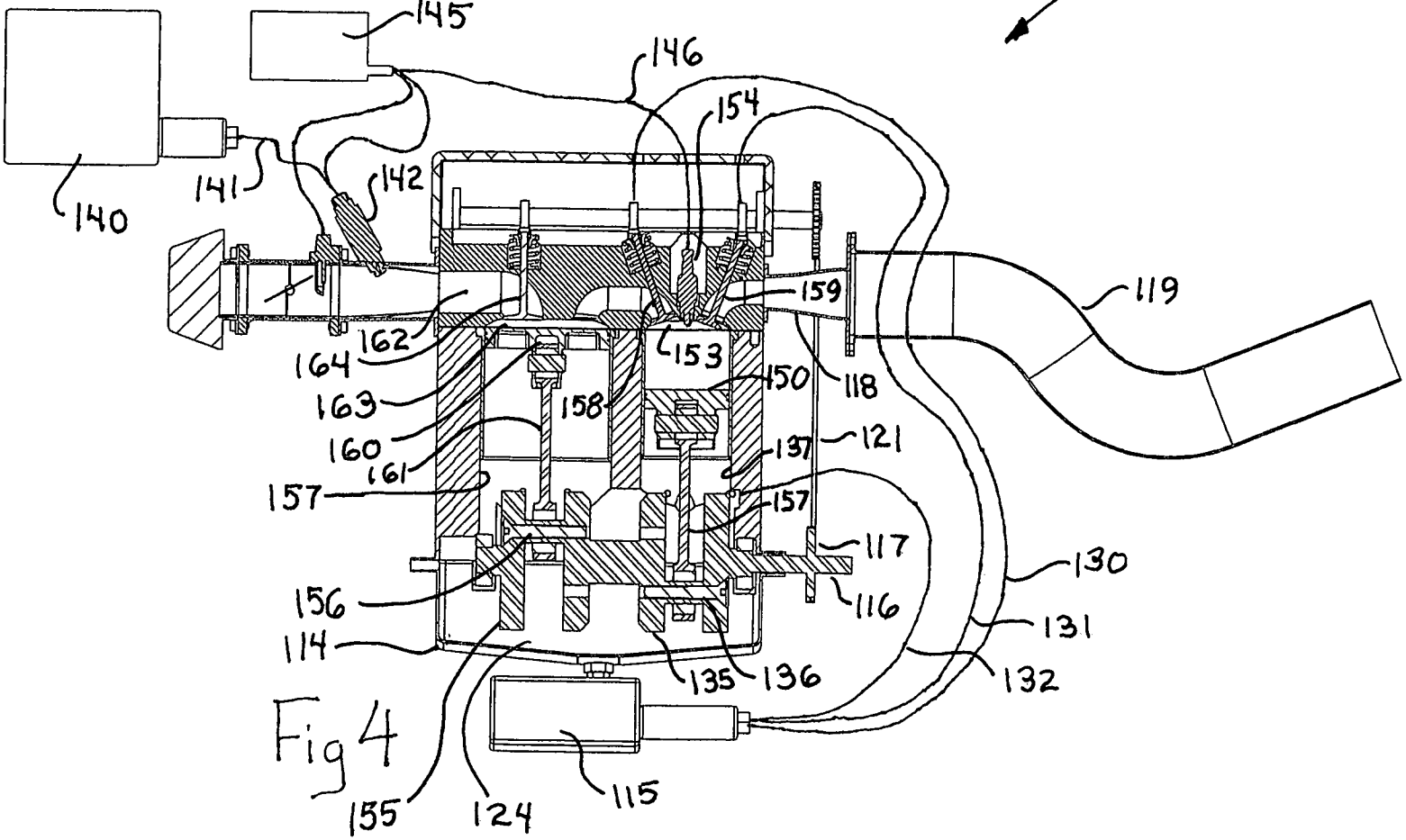
FIG. 4 sets forth a section view of the two-stroke engine having fuel/air transfer piston of FIG. 3 constructed in accordance with the present invention.

FIG. 4 sets forth a section view of engine 100. As is described above, engine 100 includes an engine block 111 which defines an air/fuel transfer cylinder and a combustion cylinder. Engine 100 further includes a cylinder head 112 which supports a plurality of movable valves to control the flow of air and fuel through engine 100. Engine 100 further includes and intake 113 which is coupled to cylinder head 112 and which, in turn, supports a throttle control 125. Intake 113 further supports a flow sensor 147 and a fuel injector 142. Engine 100 also includes a fuel pump 140 which may comprise a conventional electric fuel pump and which will be understood to be coupled to a conveniently located fuel tank (not shown). Fuel pump 140 provides a pressurized flow of fuel which is coupled by a fuel line 141 to fuel injector 142.

As is also described above, engine 100 further includes an engine controller 145 which is preferably microprocessor based and which provides electronic control of fuel injector 142 and receives input information from sensor 147. Engine control 145 also includes a source of electronic ignition which is coupled to engine 100 by an ignition line 146.

As is also described above, engine block 111 further supports a crankcase 114 within which a crankcase 124 volume is formed. As mentioned above, engine 100 is operated utilizing a dry sump lubricating system. Dry sump lubricating systems differ from the above-mentioned wet some systems in that oil is pumped from the crankcase volume and recirculated to the engine rather than utilizing the splash lubrication which characterizes wet sump oilers. An oil pump 115 is coupled to the interior of crankcase 124 and is operative to provide a pressurized flow of lubricating oil which is coupled to the appropriate portions of engine 100 by a plurality of oil pressure lines 130, 131 and 132. A crankshaft 116 is rotatably supported by engine block 111 and further supports a timing gear 117. Cylinder head 112 rotatably supports a camshaft 120 which, in turn, supports a cam gear 122. A timing chain 121 engages timing gear 117 and cam gear 122 to synchronize the rotation of camshaft 120 to crankshaft 116. Cylinder head 112 further supports an exhaust output 118 which, in turn, is joined to an exhaust pipe 119.

Crankshaft 116 is rotatably supported at the bottom end of engine block 111 by a plurality of conventional bearings. Crankshaft 116 may be constructed in accordance with conventional fabrication techniques and includes offset eccentric crankshaft lobes 135 and 155. Crankshaft journal 136 is positioned off center or eccentric within crankshaft lobe 135. Similarly, crankshaft journal 156 is positioned within crankshaft lobe 155 in an offset or eccentric position. Of importance to note with respect to the present invention and as is set forth below in greater detail, the offsets of crankshaft journals 136 and 156 are substantially 180 crankshaft degrees apart. This phase relationship is described below in greater detail. However, suffice it to note here that the phase relationship between crankshaft journals 136 and 156 results in oppositely positioning their respective pistons within their respective cylinder bores.

Engine block 111 defines a combustion cylinder bore 137 and a transfer cylinder bore 157. A piston 150 is supported within combustion cylinder bore 137 for reciprocating movement and is joined to journal 136 of crankshaft lobe 135 by a connecting rod 151. Similarly, a fuel/air transfer piston 160 is positioned within transfer cylinder bore 157 for reciprocating movement and is coupled to journal 156 of crankshaft lobe 155 by a connecting rod 161. Thus, as crankshaft 116 is rotated, piston 150 is reciprocated within combustion cylinder bore 137 and fuel air transfer piston 160 is reciprocated within transfer bore 157.

Cylinder head 112 defines an intake port 162 and a cylinder head volume 163. An intake valve 164 is operative to open and close the flow passage between intake port 162 and cylinder head volume 163 under the control of camshaft 120. Cylinder head 112 further defines a cylinder head volume 153 having an exhaust port 152 in communication therewith. Cylinder head 112 also defines a fuel air transfer port 165 extending between cylinder head volumes 163 of transfer bore 157 to cylinder head volume 153 of combustion bore 137. An intake valve 158 is positioned within cylinder head 112 and is actuated by cam shaft 120. Intake valve 158 controls the flow between transfer port 165 and cylinder head volume 153. An exhaust valve 159 is supported within cylinder head 112 and is actuated by camshaft 20. Exhaust valve 159 operates to control the flow from cylinder head volume 153 through exhaust port 152. A spark plug 154 is supported within cylinder head 112 and extends into cylinder head volume 153.

In operation, as crankshaft 116 rotates, piston 150 is reciprocated within combustion cylinder bore 137 in a two-stroke operation in which camshaft 120 moves intake valve 158 to allow the introduction of a fresh charge of fuel air mixture into cylinder head volume 153 which is then compressed as valve 158 is closed and piston 150 moves upwardly until spark plug 154 is activated to ignite the fuel air mixture compressed within cylinder head volume 153. Thereafter, the burning fuel air mixture forces piston 150 back downwardly as camshaft 120 actuates exhaust valve 159 to expel burned gases from cylinder head volume 153.

In accordance with an important aspect of the present invention the out of phase relationship of substantially 180 crankshaft degrees between the reciprocation of piston 150 and piston 160 results in the downward movement of piston 160 as piston 150 moves upwardly and an upward movement of piston 160 as piston 150 moves downwardly. It will be noted that this phase relationship is expressed as "substantially 180 crankshaft degrees." However, it will be recognized that variations in this angular relationship of plus or minus small angular increments of approximately twenty crankshaft degrees may be utilized to achieve the desired tuning of the engine. Thus, the term "substantially 180 crankshaft degrees" will be understood to embrace variations of plus and/or minus twenty crankshaft degrees. As a result, each time piston 150 is reciprocated in accordance with the two-stroke power producing operation thereof, piston 160 moves downwardly while valve 164 is open drawing a fresh quantity of fuel/air mixture into transfer cylinder bore 157 which is then transferred as piston 160 moves upwardly and valve 164 closes through transfer port 165 past open valve 158 into cylinder head volume 153 providing a fresh charge of fuel/air mixture into combustion cylinder bore 137 as piston 150 begins its upward compression stroke. This operation continues as piston 160 in cooperation with valve 164 and camshaft 120 draws in successive fuel/air charges which are then transferred through transfer port 165 into combustion cylinder bore 137 each time the intake valve 158 is open to maintain the two-stroke power producing operation of engine 100

Figure 5:
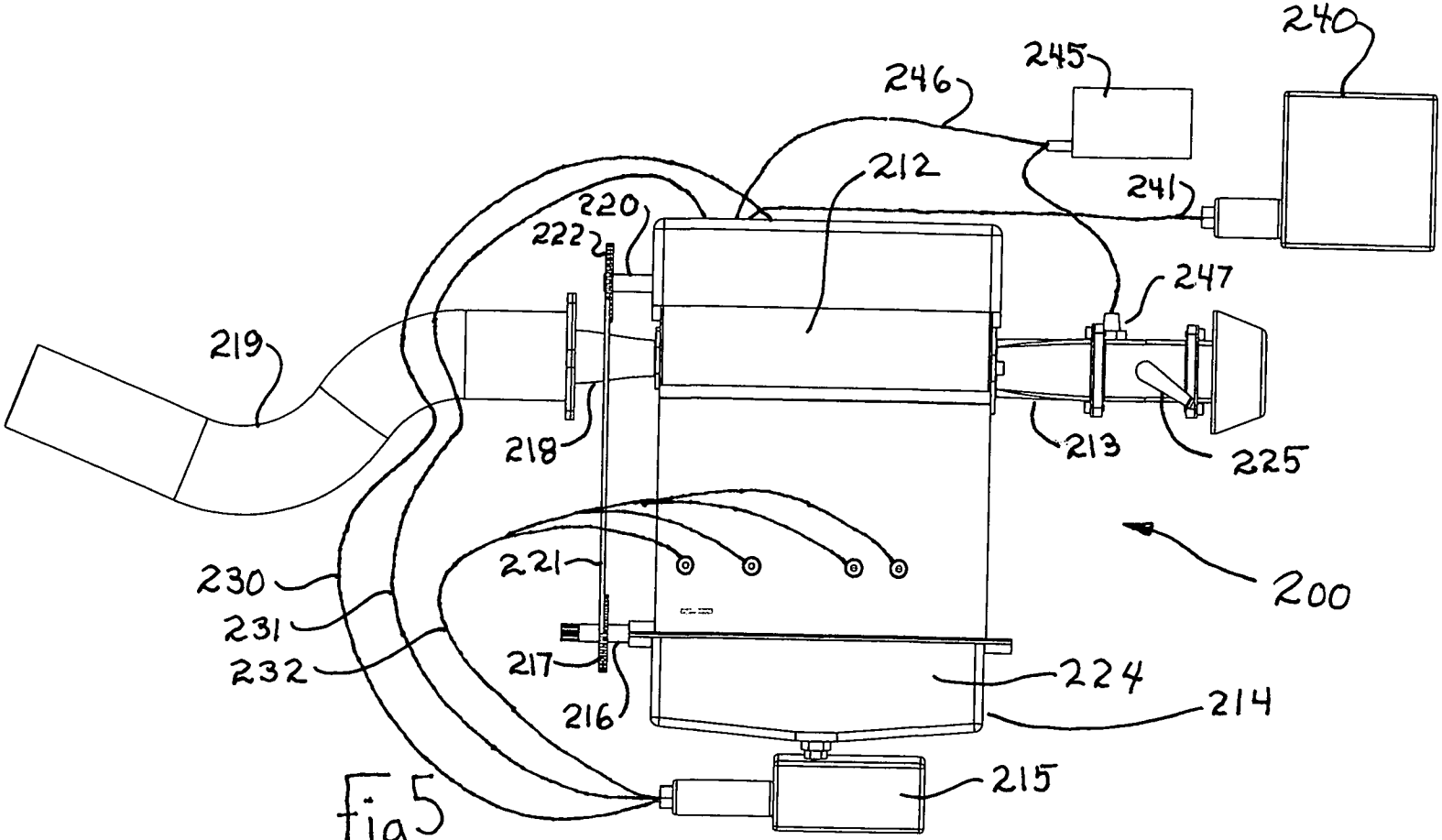
FIG. 5 sets forth a side elevation view of a further alternate embodiment a two-stroke engine having fuel/air transfer piston constructed in accordance with the present invention utilizing a diesel type engine.

FIG. 5 sets forth a side elevation view of a further alternate embodiment a two-. Stroke engine having fuel/air transfer piston constructed in accordance with the present invention utilizing a diesel type engine; and generally referenced by numeral 200. Engine 200 includes an engine block 211 which, as is better seen below, defines an air/fuel transfer cylinder and a combustion cylinder. Engine 200 further includes a cylinder head 212 which, as is also set below in greater detail, supports a plurality of movable valves to control the flow of air and fuel through engine 200. Engine 200 further includes and intake 213 which is coupled to cylinder head 212 and which, in turn, supports a throttle control 225. Intake 213 further supports a flow sensor 247. Engine 200 also includes a fuel pump 240 which may comprise a conventional electric fuel pump and which will be understood to be coupled to a conveniently located fuel tank (not shown). Fuel pump 240 provides a pressurized flow of fuel which is coupled by a fuel line 241 to fuel injector 242.

Engine 200 further includes an engine controller 245 which is preferably microprocessor based and which provides electronic control of fuel injector 242 and receives input information from sensor 247.

Engine block 211 further supports a crankcase 214 within which a crankcase 224 volume is formed. An oil pump 215 is coupled to the interior of crankcase 224 and is operative to provide a pressurized flow of lubricating oil which is coupled to the appropriate portions of engine 200 by a plurality of oil pressure lines 230, 231 and 232. A crankshaft 216 is rotatably supported by engine block 211 and further supports a timing gear 217. Cylinder head 112 rotatably supports a camshaft 120 which, in turn, supports a cam gear 122. A timing chain 221 engages timing gear 217 and cam gear 222 to synchronize the rotation of camshaft 220 to crankshaft 216. Cylinder head 212 further supports an exhaust output 218 which, in turn, is joined to an exhaust pipe 219.

Figure 6:
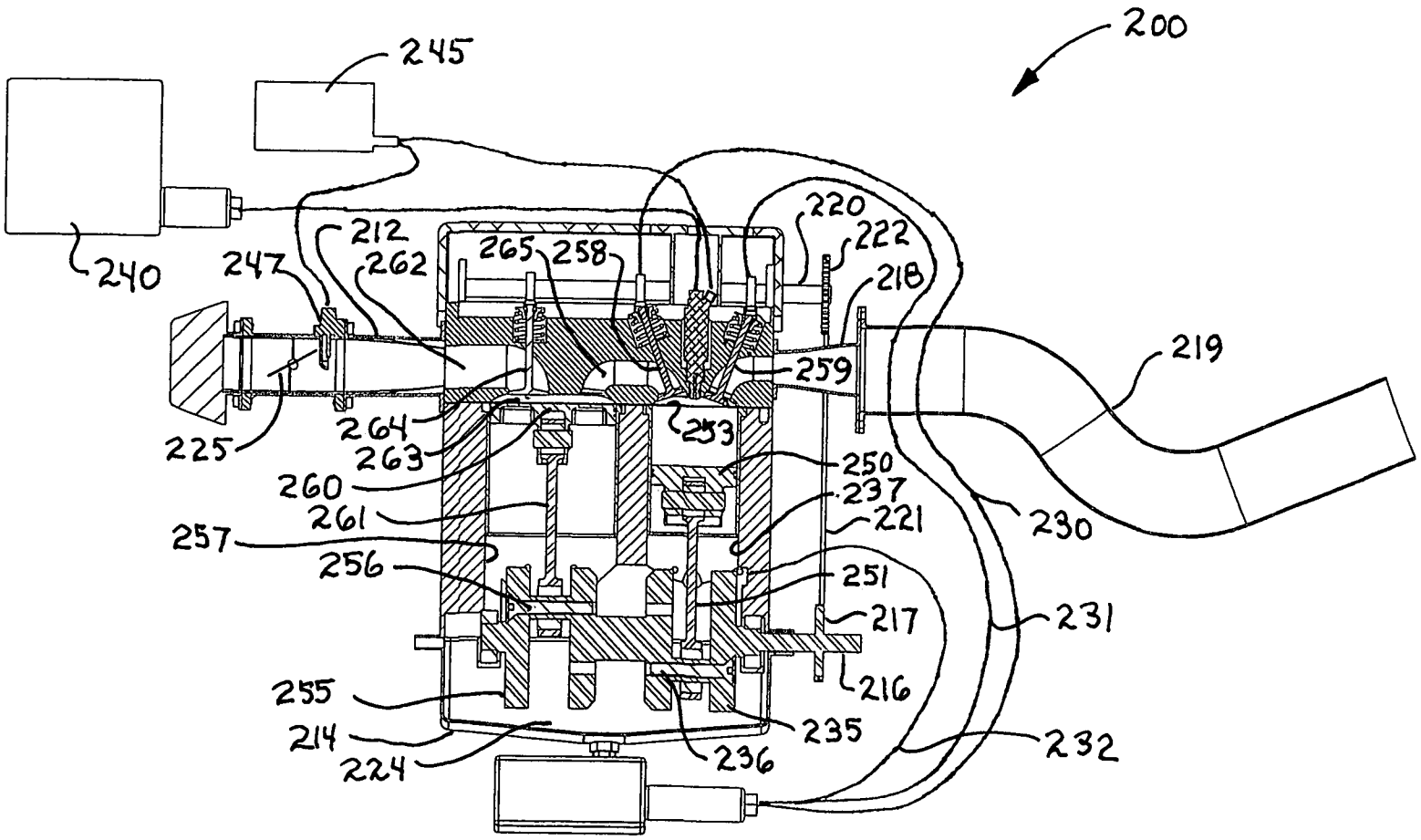
FIG. 6 sets forth a section view of the two-stroke engine having fuel/air transfer piston of FIG. 5 constructed in accordance with the present invention.

FIG. 6 sets forth a section view of diesel type engine 200. As is described above, engine 200 includes an engine block 211 which defines an air/fuel transfer cylinder and a combustion cylinder. Engine 200 further includes a cylinder head 212 which supports a plurality of movable valves to control the flow of air and fuel through engine 200. Engine 200 further includes and intake 213 which is coupled to cylinder head 212 and which, in turn, supports a throttle control 225. Intake 213 further supports a flow sensor 247. Engine 200 also includes a fuel pump 240 which may comprise a conventional electric fuel pump and which will be understood to be coupled to a conveniently located fuel tank (not shown). Fuel pump 240 provides a pressurized flow of fuel which is coupled by a fuel line 241 to fuel injector 242. As is also described above, engine 200 further includes an engine controller 245 which is preferably microprocessor based which receives input information from sensor 247.

As is also described above, engine block 211 further supports a crankcase 214 within which a crankcase 224 volume is formed. As mentioned above, engine 200 is operated utilizing a dry sump lubricating system. An oil pump 215 is coupled to the interior of crankcase 224 and is operative to provide a pressurized flow of lubricating oil which is coupled to the appropriate portions of engine 200 by a plurality of oil pressure lines 230, 231 and 232. A crankshaft 216 is rotatably supported by engine block 211 and further supports a timing gear 217. Cylinder head 212 rotatably supports a camshaft 220 which, in turn, supports a cam gear 222. A timing chain 221 engages timing gear 217 and cam gear 222 to synchronize the rotation of camshaft 220 to crankshaft 216. Cylinder head 212 further supports an exhaust output 218 which, in turn, is joined to an exhaust pipe 219.

Crankshaft 216 is rotatably supported at the bottom end of engine block 211 by a plurality of conventional bearings. Crankshaft 216 may be constructed in accordance with conventional fabrication techniques and includes offset eccentric crankshaft lobes 235 and 255. Crankshaft journal 236 is positioned off center or eccentric within crankshaft lobe 235. Similarly, crankshaft journal 256 is positioned within crankshaft lobe 255 in an offset or eccentric position. Of importance to note with respect to the present invention and as is set forth below in greater detail, the offsets of crankshaft journals 236 and 256 are substantially 180 crankshaft degrees apart. This phase relationship is described below in greater detail. However, suffice it to note here that the phase relationship between crankshaft journals 236 and 256 results in oppositely positioning their respective pistons within their respective cylinder bores.

Engine block 211 defines a combustion cylinder bore 237 and a transfer cylinder bore 257. A piston 250 is supported within combustion cylinder bore 237 for reciprocating movement and is joined to journal 236 of crankshaft lobe 235 by a connecting rod 251. Similarly, an air transfer piston 260 is positioned within transfer cylinder bore 257 for reciprocating movement and is coupled to journal 256 of crankshaft lobe 255 by a connecting rod 261. Thus, as crankshaft 216 is rotated, piston 250 is reciprocated within combustion cylinder bore 237 and air transfer piston 260 is reciprocated within transfer bore 257.

Cylinder head 212 defines an intake port 262 and a cylinder head volume 263. An intake valve 264 is operative to open and close the flow passage between intake port 262 and cylinder head volume 263 under the control of camshaft 220. Cylinder head 212 further defines a cylinder head volume 253 having an exhaust port 252 in communication therewith. Cylinder head 212 also defines an air transfer port 265 extending between cylinder head volumes 263 of transfer bore 257 to cylinder head volume 253 of combustion bore 237. An intake valve 258 is positioned within cylinder head 212 and is actuated by cam shaft 220. Intake valve 258 controls the flow between transfer port 265 and cylinder head volume 253. An exhaust valve 259 is supported within cylinder head 212 and is actuated by camshaft 220. Exhaust valve 259 operates to control the flow from cylinder head volume 253 through exhaust port 252. A fuel injector 242 is supported within cylinder head 212 and extends into cylinder head volume 253.

In operation, as crankshaft 216 rotates, piston 250 is reciprocated within combustion cylinder bore 237 in a two-stroke diesel operation in which camshaft 220 moves intake valve 258 to allow the introduction of a fresh charge of air into cylinder head volume 253 which is then compressed as valve 258 is closed and piston 250 moves upwardly until fuel injector 242 is activated to spray fuel into the compressed air within cylinder head volume 253 which spontaneously ignites. Thereafter, the burning fuel air mixture forces piston 250 back downwardly as camshaft 220 actuates exhaust valve 259 to expel burned gases from cylinder head volume 253.

In accordance with an important aspect of the present invention the out of phase relationship of substantially 180 crankshaft degrees between the reciprocation of piston 250 and piston 260 results in the downward movement of piston 260 as piston 250 moves upwardly and an upward movement of piston 260 as piston 250 moves downwardly. It will be noted that this phase relationship is expressed as "substantially 180 crankshaft degrees." However, it will be recognized that variations in this angular relationship of plus or minus small angular increments of approximately twenty crankshaft degrees may be utilized to achieve the desired tuning of the engine. Thus, the term "substantially 180 crankshaft degrees" will be understood to embrace variations of plus and/or minus twenty crankshaft degrees. As a result, each time piston 250 is reciprocated in accordance with the two-stroke power producing operation thereof, piston 260 moves downwardly while valve 264 is open drawing a fresh quantity of air into transfer cylinder bore 257 which is then transferred as piston 260 moves upwardly and valve 264 closes through transfer port 265 past open valve 258 into cylinder head volume 253 providing a fresh charge of air into combustion cylinder bore 237 as piston 250 begins its upward compression stroke. This operation continues as piston 260 in cooperation with valve 264 and camshaft 220 draws in successive air charges which are then transferred through transfer port 265 into combustion cylinder bore 237 each time the intake valve 258 is open to maintain the two-stroke power producing operation of engine 200

What has been shown is an improved two-stroke engine that avoids the need for creating a pressurized condition within the engine crankcase and avoids the need for free mixing fuel and lubricating oil prior to combustion. The two-stroke engine shown may be operated utilizing either a dry sump or wet sump lubricating system.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A two-stroke engine comprising:

an engine block defining a combustion cylinder bore and a transfer cylinder bore;

a cylinder head supported upon said engine block overlying said combustion cylinder bore and said transfer cylinder bore defining a first cylinder head volume aligned with said combustion cylinder bore and a second cylinder head volume aligned with said transfer cylinder bore, an intake port supplying fuel/air mixture extending from said second cylinder head volume, an exhaust port extending from said first cylinder head volume, and a transfer port having a first end at said first cylinder head volume and a second end at said second cylinder head volume, said transfer port extending between said first cylinder head volume and said second cylinder head volume;

a first intake valve supported within said first cylinder head volume at said first end of said transfer port providing closure of said transfer port;

an exhaust valve supported within said cylinder head providing closure of said exhaust port;

a fuel igniter supported within said cylinder head and extending into said first cylinder head volume;

a second intake valve supported within said cylinder head providing closure of said intake port;

a crankshaft rotatably supported upon said engine block having first and second eccentric crankshaft lobes, said first and second eccentric crankshaft lobes being positioned substantially 180 crankshaft degrees out of phase;

a combustion cylinder piston movable within said combustion cylinder bore and a first connecting rod coupling said combustion cylinder piston to said first eccentric crankshaft lobe;

a transfer cylinder piston movable within said transfer cylinder bore and a second connecting rod coupling said transfer cylinder piston to said second eccentric crankshaft lobe; and a camshaft rotatably coupled to said crankshaft operative to open and close said first and second intake valves and said exhaust valve, whereby said combustion cylinder piston within said combustion cylinder bore is operated in a two-stroke cycle and said transfer cylinder piston within said transfer cylinder bore draws in charges of fuel/air mixture through said intake port and transfers it to said first cylinder head volume.

2. The two-stroke engine set forth in claim 1 wherein said two-stroke engine includes a dry sump lubrication system.

3. The two-stroke engine set forth in claim 1 wherein said two-stroke engine includes a wet sump lubrication system.

4. A two-stroke engine comprising:

a combustion cylinder having, a combustion cylinder bore, a combustion cylinder piston, a combustion cylinder head defining a combustion cylinder head volume, a combustion cylinder intake valve and exhaust valve within said combustion cylinder head volume, a combustion cylinder connecting rod;

a fuel/air transfer cylinder having, a fuel/air transfer cylinder bore, a fuel/air transfer piston, a fuel/air transfer cylinder head defining a fuel/air transfer cylinder head volume, a fuel/air transfer intake valve within said fuel/air transfer cylinder head volume, a fuel/air transfer cylinder connecting rod;

a fuel/air transfer port extending between said combustion cylinder head volume and said fuel/air transfer cylinder head volume;

a crankshaft supported for rotation having first and second eccentric crankshaft lobes substantially 180 crankshaft degrees out of phase; and a source of fuel/air mixture, said combustion cylinder connecting rod being coupled to said first eccentric crankshaft lobe and said fuel/air transfer cylinder connecting rod being connected to said second eccentric crankshaft lobe, whereby said combustion cylinder piston within said combustion cylinder bore is operated in a two-stroke cycle and said transfer cylinder piston within said transfer cylinder bore draws in charges of fuel/air mixture through said intake port and transfers it to said combustion cylinder head volume through said transfer port.

* * * * *